US007052283B2

(12) United States Patent
Pixley et al.

(10) Patent No.: US 7,052,283 B2
(45) Date of Patent: May 30, 2006

(54) SHEATH CURRENT ATTENUATOR FOR COAXIAL CABLE

(75) Inventors: Henry Pixley, East Syracuse, NY (US); Raymond Palinkas, Canastota, NY (US); Robert Benson, Liverpool, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/871,255

(22) Filed: Jun. 18, 2004

(65) Prior Publication Data

US 2005/0282433 A1 Dec. 22, 2005

(51) Int. Cl.
*H01R 11/30* (2006.01)
*H01R 13/60* (2006.01)

(52) U.S. Cl. ..... 439/38; 439/620; 336/92

(58) Field of Classification Search ..... 439/620, 439/38

See application file for complete search history.

(56) References Cited

U.S. PATENT DOCUMENTS

| | | | | |
|---|---|---|---|---|
| 2,932,805 | A | 4/1960 | Doherty | |
| 3,171,091 | A * | 2/1965 | Goldsmith | 336/83 |
| 3,715,673 | A | 2/1973 | Baum et al. | |
| 4,149,170 | A | 4/1979 | Campbell et al. | |
| 4,818,957 | A | 4/1989 | Cort | |
| 4,885,555 | A | 12/1989 | Palmer | |
| 4,922,204 | A | 5/1990 | Duerr et al. | |
| 4,958,134 | A | 9/1990 | Sawa et al. | |
| 5,091,707 | A | 2/1992 | Wollmerschauser et al. | |
| 5,184,331 | A | 2/1993 | Sullivan et al. | |
| 5,287,008 | A | 2/1994 | Pahr | |
| 5,346,410 | A * | 9/1994 | Moore, Jr. | 439/607 |
| 5,650,908 | A * | 7/1997 | Stanton | 361/113 |
| 5,850,114 | A | 12/1998 | Froidevaux | |
| 5,990,756 | A | 11/1999 | France, Jr. et al. | |
| 6,072,125 | A | 6/2000 | Takeuchi | |
| 6,218,913 | B1 | 4/2001 | Pagenkopf | |
| 6,547,596 | B1 * | 4/2003 | Pavlovic et al. | 439/620 |
| 2001/0050605 | A1 * | 12/2001 | Sugiura et al. | 336/92 |

* cited by examiner

*Primary Examiner*—Hae Moon Hyeon
(74) *Attorney, Agent, or Firm*—Wall Marjama & Bilinski LLP

(57) ABSTRACT

A device for use with coaxial cable to attenuate sheath currents associated therewith. The device is adapted to be coupled to incoming and outgoing coaxial cables and includes a ferrite core configured as a first hollow cylinder mounted coaxially within a housing configured as a second hollow cylinder. A conductor within the housing has opposite ends positioned for electrical contact with the incoming and outgoing coaxial cables and an intermediate portion passing through the ferrite core longitudinally at least twice, being passed back over the outside surface of the core between passes therethrough. The elements are so dimensioned that the outside diameter of the housing is less than one inch, thereby allowing side-by-side mounting of a plurality of the devices on industry-standard, multi-port taps which have center-to-center spacings of one inch.

9 Claims, 3 Drawing Sheets

600
610
620
D 620
630
640

620
622
624
626
628
629
650
640
630
629
650
628
658
626
624
622
620

628
658
620
622
624
626
629
650
640
630

620
622
L
630
640
622
620

6F
622
610
622
620
622
658
622
6F

SHEATH CURRENT ATTENUATOR FOR COAXIAL CABLE

FIELD OF THE INVENTION

The present invention relates to devices for use with cable TV coaxial cables, and more specifically to devices configured and dimensioned for installation on conventional multi-port taps for attenuating so-called sheath current associated with the outer surface of the coaxial cable outer conductor.

BACKGROUND OF THE INVENTION

Studies of broadband coaxial cable distribution plants have shown that secondary, "off-air" RF signals picked up by (or impressed upon) the cable system coaxial cable are carried by the cable shielding as a current, commonly termed a sheath current. This current can result in ingress and egress problems due to openings in the cable outer conductor and/or poor connector attachment, as well as "ghosting" of the displayed image. Also, sheath currents propagate from the outer conductor to the ground soil and/or ground block and can accelerate galvanic corrosion within the cable outer conductor.

Efforts to address the problems associated with sheath current fall generally into two categories. In a first type of device for attenuating off-air RF signals that are picked up and conducted by coaxial cable shielding, disclosed in U.S. Pat. Ser. No. 5,091,707, a filter is formed by wrapping the coaxial conductor several turns around each of two, doughnut shaped, ferromagnetic toroidal cores. In a second type, found for example in U.S. Pat. Ser. Nos. 4,885,555, 5,990,756 and 6,072,125, the conductor makes a single, longitudinal pass through a hollow, ferrite cylinder to provide a choke, wave trap, or the like. However, in order to achieve the required attenuation of approximately 20 db, such devices cannot be packaged effectively for mounting on conventional, multi-port taps where the center-to-center spacing is one inch.

There is a need for a coaxial cable connector device for use in cable TV applications which will effectively attenuate sheath currents on the outside surface of the outer conductor and which are mounted in side-by-side relation on conventional, multi-port taps.

SUMMARY OF THE INVENTION

In one embodiment, the device of the invention includes a hollow, cylindrical housing having an outside diameter less than one inch, e.g., about 0.95 inch. Mounted coaxially within the housing is a hollow cylinder of ferrite material. An appropriate length of coaxial cable is connected at opposite ends to connectors. The connectors can be two male connectors, two female connectors, or one male and one female connector. In one embodiment, between its ends, the cable is passed through the ferrite cylinder, looped around the outside of the cylinder and passed through the cylinder at least one (preferably two) additional time(s). In another embodiment, the cable is wound around an elongated ferrite body. The inner conductor of the coaxial cable passes through one connector of the device for contact with the conductor within the device, and the other connector is mated with another section of coaxial cable or directly to a TV receiver or VCR. The sheath current traveling on the outside surface of the cable outer conductor generates associated electromagnetic fields. These magnetic fields are impeded due to the permeability of the ferrite material which, in turn, attenuates the associated electric fields (currents) traveling on the outside surface of the cable outer conductor.

In one aspect, the invention relates to a coaxial cable device for attenuating sheath currents which are present on the outer surface of the cable. The device comprises an outer housing having first and second ends and a maximum transverse dimension intermediate of the ends, representing the maximum transverse dimension of the device, of not more than one inch; an input connector mounted to the housing at the first end and adapted to be connected with an incoming coaxial cable; an output connector mounted to the housing at the second end and adapted to be connected with an outgoing coaxial cable; a ferrite core configured as a hollow cylinder having a first central axis, first inner and outer surfaces, first inside and outside diameters and a length substantially greater than the first outside diameter; and a conductor having opposite ends in electrical contact with the input and output connectors, respectively, the conductor passing through the core, passing back along the outer surface of the core and passing again through the core.

In one embodiment, the housing is configured as a second hollow cylinder having a second central axis, second inner and outer surfaces and second inside and outside diameters. In one embodiment, the core is mounted substantially coaxially within the housing. In one embodiment, the second inside diameter is approximately one-fourth inch greater than the first outside diameter, thereby providing a clearance of approximately one-eighth inch between the first outer and the second inner surfaces about the periphery thereof. In one embodiment, the conductor passes longitudinally through the core four times, passing over the first outer surface three times. In one embodiment, the conductor is incorporated in a 75 ohm coaxial cable. In one embodiment, the housing is of non-conducting material. In one embodiment, the non-conducting material is ABS plastic. In one embodiment, the core has a length at least 12 times the first outside diameter.

In another aspect, the invention features an attenuator for attenuating sheath currents which are present on the outer surface of a coaxial cable in a CATV system. The attenuating means comprises a housing means defining a cavity having a central axis and first and second ends; input means mounted to the first end of the housing means for receiving a signal from a first coaxial cable; output means mounted to the second end of the housing means for communicating the signal to a second coaxial cable; connecting means extending between the input and output means for communicating the signal from the input to the output means; and attenuating means in the form of a hollow, cylindrical, ferrite core mounted within the housing means and through which the connecting means extends at least twice, the housing means having a maximum transverse dimension of not more than one inch, whereby a pair of the housing means are mounted side-by-side with the central axes in parallel relation and spaced by not more than one inch.

In one embodiment, the connecting means comprises a coaxial cable passing through the core, being passed back along the outer surface of the core and passed again through the core. In one embodiment, the connecting means comprises a coaxial cable passing through the core four times, being passed back along the outer surface of the core between each pass through the core. In one embodiment, the housing means is of non-conducting material. In one embodiment, the material is ABS plastic. In one embodiment, the core is substantially coaxially mounted within the housing means. In one embodiment, the core is mounted substantially equidistant from the first and second ends of the housing means.

In yet another aspect, the invention relates to a method of attenuating sheath currents which are present on a coaxial cable in a CATV system. The method comprises the steps of providing an enclosed housing defining a cavity and having a central axis with first and second ends, and a maximum lateral dimension of not more than one inch; passing a conductor through a hollow, cylindrical, ferrite core, wrapping the conductor back along the outer surface of the core, and passing the conductor again through the core; mounting the conductor and core within the housing means; mounting a input connector to the first end of the housing; mounting an output connector to the second end of the housing; and connecting opposite ends of the conductor to the input and output connectors, respectively.

In one embodiment, the method further comprises mounting a pair of the housings with the conductor and core mounted therein and the input and output conductors mounted thereon, to adjacent ports of video equipment, the ports being spaced an industry-standard one inch on centers. In one embodiment, the core is mounted substantially coaxially within the cavity. In one embodiment, the conductor is passed four times through the core, being passed back over the outer surface of the core between each pass through the core.

In a still further aspect, the invention features a coaxial cable device. The coaxial cable device comprises an enclosure defining a cavity, the enclosure having first and second ends, the enclosure having a maximal external transverse dimension; two coaxial connector bodies, of which one body is disposed at each of the first and second ends of the enclosure, each of the connector bodies configured to connect an external coaxial cable device to an end of a coaxial cable disposed with the enclosure; a ferrite body disposed within the enclosure; and a coaxial cable disposed within the enclosure adjacent the ferrite body and making at least one circumnavigation thereabout, the coaxial cable connected at a first end to one of the coaxial connector bodies and at a second end to another of the coaxial connector bodies. Sheath currents which are present on the outer surface of a coaxial cable connected to the device are attenuated.

In one embodiment, the enclosure comprises non-conducting material. In one embodiment, the non-conducting material is ABS plastic. In one embodiment, the maximal external transverse dimension is less than one inch.

In yet a further aspect, the invention features a coaxial cable device. The coaxial cable device comprises a ferrite body; a coaxial conductor having a first end and a second end, the coaxial conductor disposed adjacent the ferrite body and making at least one circumnavigation thereabout; and a coaxial connector body disposed at each of the first and second ends of the coaxial conductor and electrically connected thereto, each of the connector bodies configured to connect the end of the coaxial conductor to an external coaxial cable-based device. The coaxial cable device attenuates sheath currents which are impressed on the outer surface of the coaxial conductor.

In some embodiments, the device further comprises an encapsulant defining a cavity within which the ferrite core and the coaxial conductor are disposed, the encapsulant attached to at least one of the coaxial connector body disposed at either of the first and second ends of the coaxial conductor. In some embodiments, a maximal external transverse dimension of the device is less than one inch. In one embodiment, the coaxial conductor comprises a self-supporting outer conductor. In one embodiment, the self-supporting outer conductor comprises a copper tube having a wall of sufficient thickness and strength.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
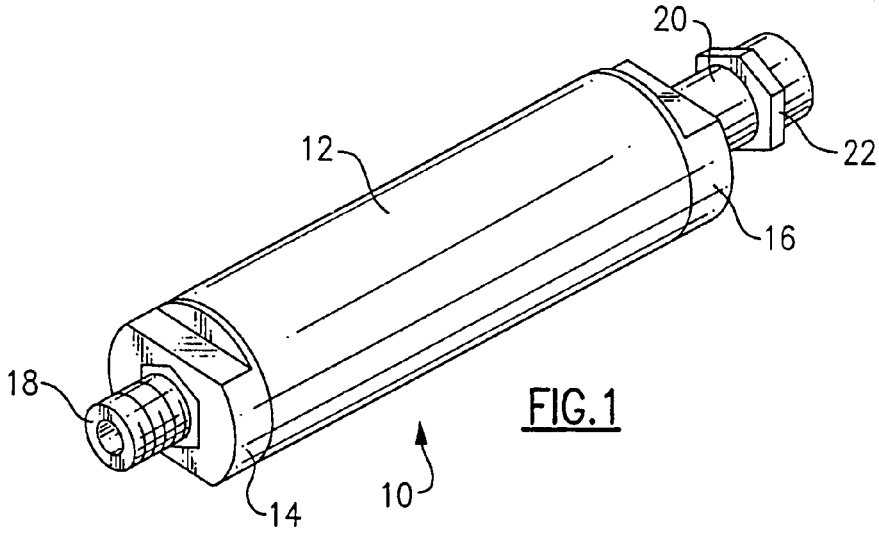
FIG. 1 is a perspective view of a first embodiment of a sheath current attenuator device of the invention in fully assembled form.
Figure 2:
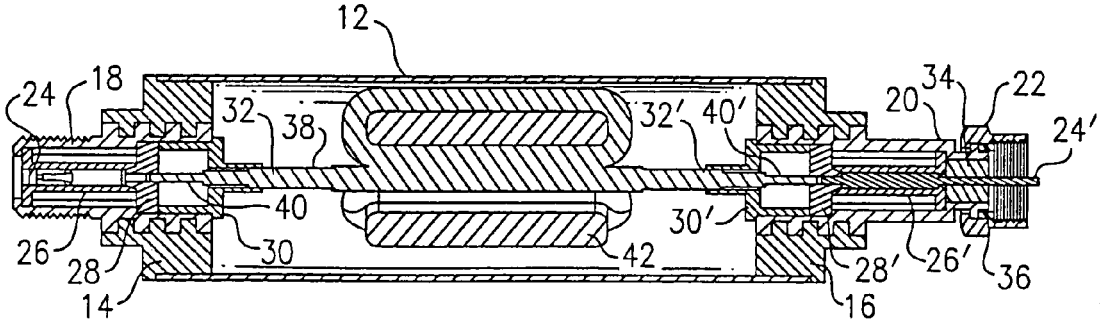
FIG. 2 is a side elevation view of the device of FIG. 1 in section through the center.
Figures 3, 4, 4A, 5:
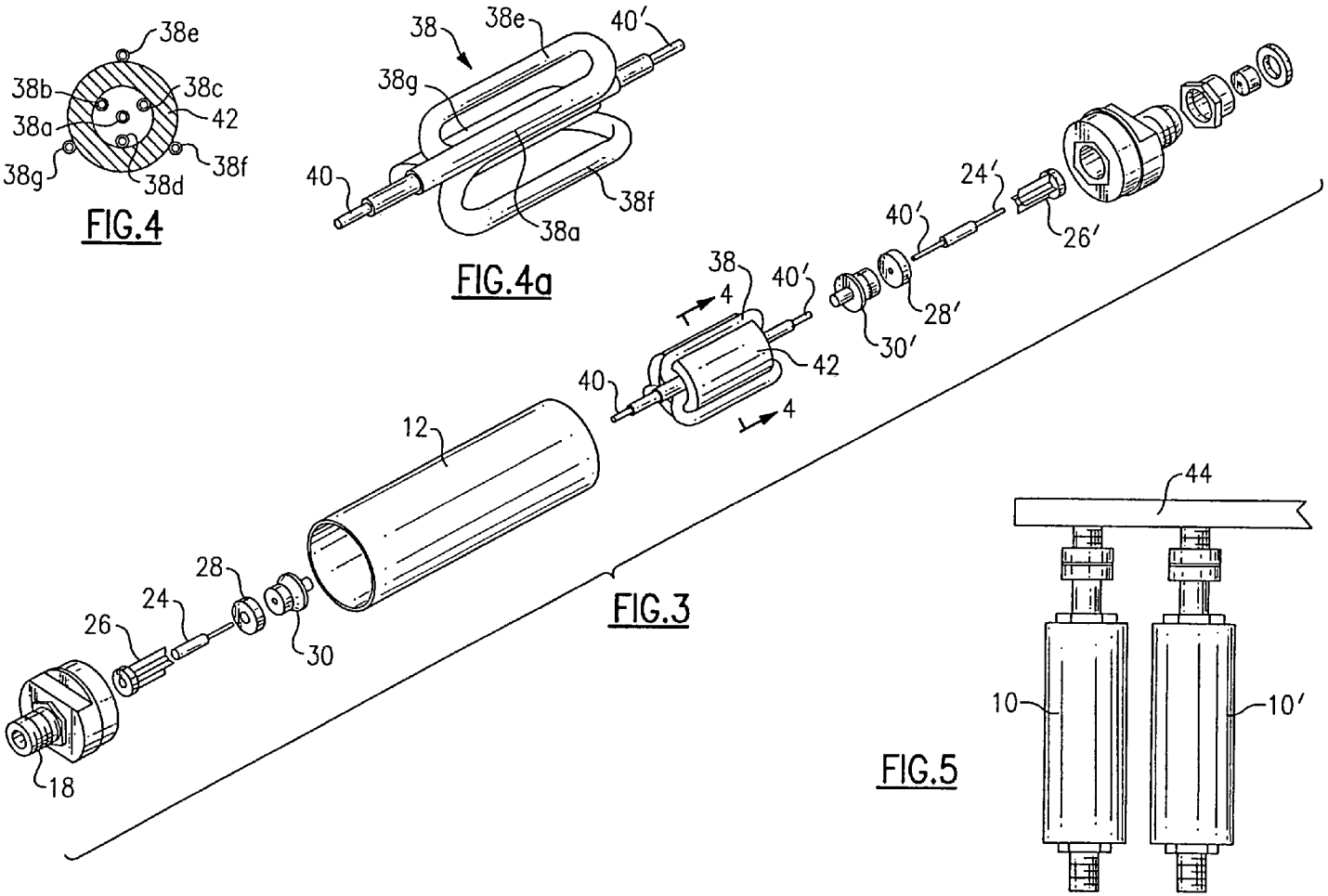
FIG. 3 is an exploded perspective view of the device.
FIG. 4 is an end elevation view in cross section on the line A—A of FIG. 3.
FIG. 4*a* is a perspective view of the length of coaxial cable within the device, isolated from the other elements with which it is shown in FIGS. 3 and 4.
FIG. 5 is an elevation view of a pair of the devices mounted in side-by-side relation upon a conventional multi-port tap.

Referring now to the drawings, in FIG. 1 is shown the preferred embodiment of the device of the invention, denoted generally by reference numeral 10, in fully assembled condition. Device 10 includes cylindrical housing 12, end caps 14 and 16, female connector body 18, and male connector body 20, and nut 22 threadedly engaged on the end of male connector body 20. Elements positioned internally of the housing, end caps and connector bodies, as seen in FIGS. 2 and 3, are female contact 24, contact insulator 26, retaining washer 28, and solder body 30 with solder joint 32 at the female end. Corresponding parts at the male end are male contact 24', contact insulator 26', retaining washer 28', and solder body 30' with solder joint 32', in addition to front insulator 34 and gasket 36. Preferred materials for these elements are: ABS plastic for housing 12 and end caps 14, 16; brass alloy with tin plated finish for female and male connector bodies 18 and 20, respectively, nut 22, female and male contacts 24, 24', and solder bodies 30, 30'; nylon for contact insulators 26, 26'; Teflon for front insulator 34; and a conductive elastomer for gasket 36.

An appropriate length of coaxial cable 38, preferably a polyethylene jacketed, 75 ohm conductor, has opposite ends 40, 40' in electrical contact with female and male contacts 24, 24', respectively. Between its ends cable 38 passes longitudinally through hollow, cylindrical, ferrite core 42, is wrapped back around the outer surface of the core and passed again through the inside of the cylinder. As best seen in FIG. 4, cable 38 includes four portions 38*a*, 38*b*, 38*c* and 38*d* passing longitudinally through the inside of cylindrical core 42 and three corresponding portions 38*e*, 38*f* and 38*g* contacting the outer surface of core 42. In the device of the invention, cable 38 passes at least twice, and preferably four times, as shown, longitudinally through core 42. The axial length of core 42 is substantially greater (at least 1½ times and preferably just under two times) than its outside diameter. Cable 38 is shown in FIG. 4*a* without the ferrite core.

As previously mentioned, device 10 is dimensioned for installation on industry-standard, multi-port taps which have a center-to-center lateral spacing of one inch. In the preferred embodiment, core 42 has inside and outside diameters of 0.315 and 0.630 inches, respectively, with tolerances of plus or minus 0.012. Housing 12 has inside and outside diameters of 0.882 and 0.938 inches, respectively, with tolerances of plus or minus 0.08. With core 42 mounted coaxially within housing 12, there is a clearance of approximately one-eighth inch between the outer surface of core 42 and the inner surface of housing 12. The nominal diameter of a 75 ohm coaxial cable is 0.10 inch. The dimensions provide sufficient space for multiple passes of cable 38 through core 42 and between the outer surface of core 42 and inside surface of housing 12. The largest outside diameter of end caps 14 and 16 is the same as that of housing 12. Thus, device 10 has a maximum transverse dimension of less than one inch and two such devices, numbered 10 and 10', are mounted to multi-port tap 44 as seen in FIG. 5. Device 10 will provide approximately 20 db of attenuation over the 5 to 200 MHz frequency band while still being adapted for mounting on a conventional multi-port tap.

Figures 6A, 6B, 6C, 6D, 6E, 6F:
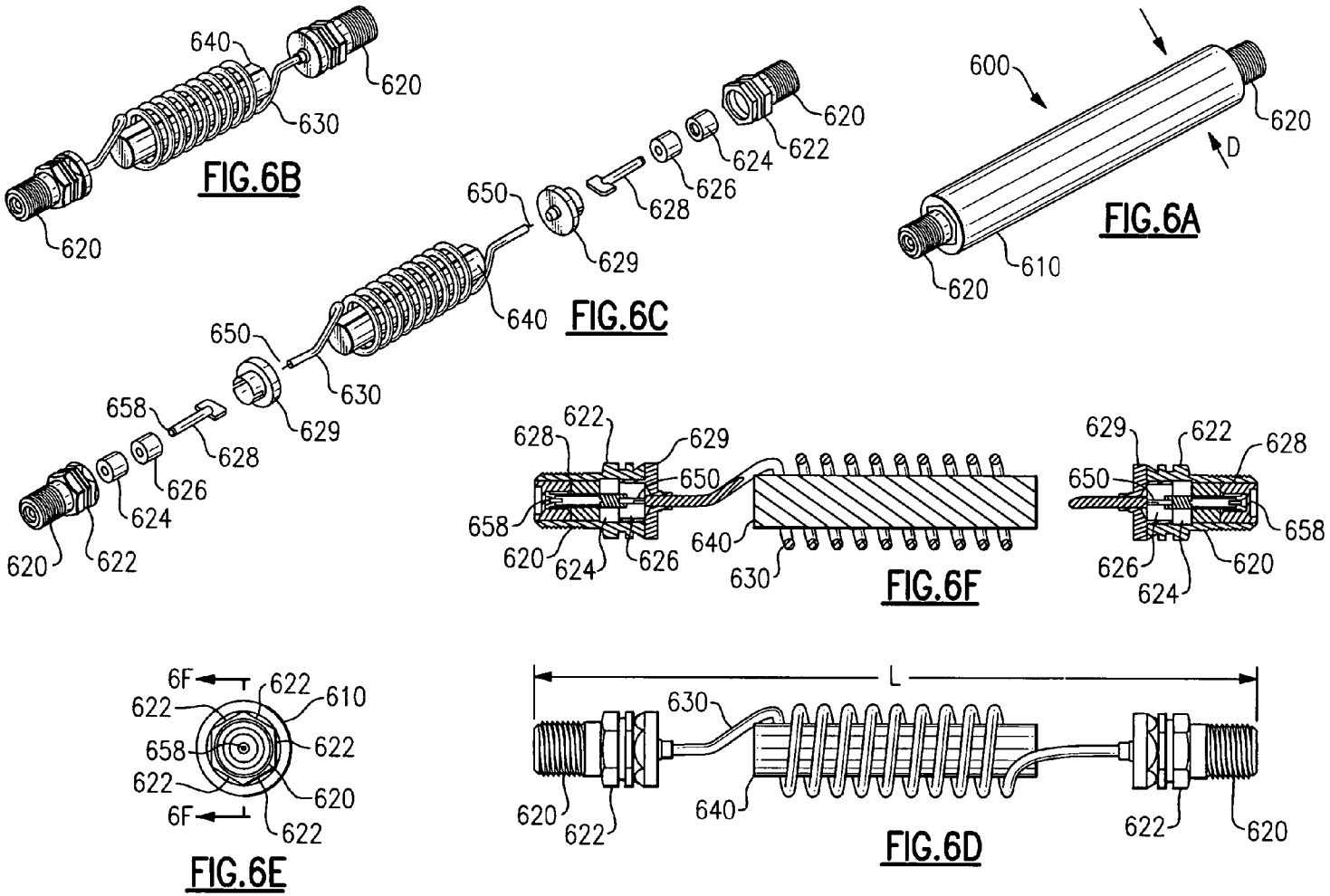
FIG. 6A is a perspective view of a second embodiment of a sheath current attenuator device of the invention in fully assembled form.
FIG. 6B is a perspective view of the second embodiment of a sheath current attenuator device of the invention with the cylindrical housing absent.
FIG. 6C is an exploded perspective view of the second embodiment of a sheath current attenuator device of the invention with the cylindrical housing absent.
FIG. 6D is a side elevation view of the second embodiment of a sheath current attenuator device of the invention with the cylindrical housing absent.
FIG. 6E is an end view of the second embodiment of the sheath current attenuator device of the invention as shown in FIG. 6A.
FIG. 6F is a side section view of the second embodiment of a sheath current attenuator device of the invention along line A—A of FIG. 6E.

FIG. 6A is a perspective view of a second embodiment of a sheath current attenuator device 600 of the invention in fully assembled form. The sheath current attenuator device 600 as shown has a cylindrical housing 610 which encloses the active components of the device. As above, the device is preferably less than one inch in diameter. The sheath current attenuator device 600 has male connector bodies 620 at each end of the device, for threadedly connecting each end of the device to a corresponding female connector attached to a coaxial cable, to a conventional multi-port tap, or to a suitable coaxial cable adapter. The cylindrical housing 610 is an over-mold case that can be made from a suitably strong material such as a plastic. The cylindrical housing 610 is assembled over the structure shown in FIG. 6B, and is attached to the ends thereof using any convenient method, including mechanical compression, heat shrinking, soldering, or gluing. The sheath current attenuator device has a maximal external transverse dimension D, which for the cylindrical embodiment shown is less than one inch, for example 0.95 inch. One of ordinary skill will understand that an external shape for the housing 610 other than cylindrical is possible, although a cylindrical shape provides the greatest internal volume for a given maximal external transverse dimension D, given a constant minimal acceptable wall thickness for the housing. Cylindrical housings are convenient to fabricate, and make assembly more convenient as well.

FIG. 6B is a perspective view of the second embodiment of a sheath current attenuator device of the invention with the cylindrical housing absent. In FIG. 6B a coaxial conductor 630 is wrapped around a ferrite core 640 having an elongated shape. The coaxial conductor 630 is shown as a helical winding making a plurality of loops or circumnavigations of the elongated ferrite body 640 without penetrating therethrough. In the embodiment shown, there are 10 circumnavigations. In some embodiments, a single loop or circumnavigation of the coaxial conductor 630 about the ferrite core 640 is sufficient. In a different embodiment, the coaxial conductor 630 can be wound helically around the ferrite core 640, and can penetrate therethrough through one or more apertures made therein to accommodate such passage through the ferrite core 640. In yet another embodiment, the ferrite core 640 can be provided with helical surface grooves into which one or more loops of the coaxial conductor can be laid, so as to strengthen the electromagnetic interaction between the external conductor of the coaxial cable 630 and the ferrite core 640. Each end of the coaxial conductor 630 is terminated in a male connector body 620 configured to make connection between the end of the coaxial conductor 630 and a coaxial cable device external to the sheath current attenuator device 600.

FIG. 6C is an exploded perspective view of the second embodiment of a sheath current attenuator device of the invention with the cylindrical housing absent. Again, the coaxial conductor 630 is wrapped around an elongated ferrite core 640. The exploded diagram shows in greater detail the construction of the connectors 620 and how the coaxial conductor 630 is attached thereto. Each end of the coaxial conductor 630 is terminated in a male connector body 620. Each male connector body 620 accommodates a sequence of parts, including a rubber seal 624, an insulator 626, a board pin 628, and a connector 629. The male connector body 620 has a hex head 622 formed thereon, so as to provide secure holding surfaces for threadedly connecting the male connector body 620 to a mating connector, which is not shown. The outer conductive surface of the coaxial conductor 630 is electrically connected to the male connector body 620 by way of the connector 629, for example by soldering. The inner conductor 650 of the coaxial conductor 630 is left bare, and passes through apertures defined in the male connector body 620, the rubber seal 624, the insulator 626, and the connector 629, substantially along a central axis of the assembled sheath current attenuator device. The bare end 650 of the inner connector of the coaxial conductor 630 is soldered to the board pin 628, and an exposed end 658 of the board pin 628 is accessible at the central axis of the male connector body 620 for making connection to other objects in a circuit. The elongated board pin 628 also passes through the rubber seal 624 and the insulator 626 in the assembled device.

FIG. 6D is a side elevation view of the second embodiment of a sheath current attenuator device of the invention with the cylindrical housing absent. One sees the male connector bodies 620, the coaxial conductor 630, and the elongated ferrite core 640. The hex head 622 present on each male connector body 620 is also visible. As shown in FIG. 6D, the sheath current attenuator device has a length dimension L, which is some embodiments is approximately 5 inches.

FIG. 6E is an end view of the second embodiment of the sheath current attenuator device of the invention as shown in FIG. 6A. In FIG. 6E, one sees the cylindrical housing 610, one of the male connector bodies 620, and at the center of FIG. 6E, the bare inner conductor 650 of the coaxial cable 630. The hex head 622 present on the male connector body 620 is also visible.

FIG. 6F is a side section view of the second embodiment of a sheath current attenuator device of the invention along line A—A of FIG. 6E. Again, one sees the cylindrical housing 610, one of the male connector bodies 620, and at the center of FIG. 6E, the bare inner conductor 650 of the coaxial cable 630. Also visible in cross section are hex head 622, the rubber seal 624, the insulator 626, the board pin 628, the connector 629, the inner conductor 650 of the coaxial cable 630, and the exposed end 658 of the board pin 628. As will be apparent to those of skill in the connector arts, a female connector configured to mate with male connector body 620 will have a central contact that is configured to connect to the exposed end 658 of the board pin 628, and a threaded contact configured to make electrical connection with the externally threaded portion of male connector body 620, thereby connecting both conductors of a coaxial conductor to an adjacent object properly connected to the female connector.

In another embodiment, the cylindrical housing 610 is omitted, but the structure of FIGS. 6B, 6D, and 6F is embedded in an encapsulant, such as potting material, for example a non-conductive material that sets or cures after being applied to the structure, that provides the required rigidity and protective functions otherwise provided by the cylindrical housing 610.

In still another embodiment, the cylindrical housing 610 is omitted, and the coaxial coil of FIGS. 6A–6F is constructed with a self-supporting external coax conductor (for example, a copper tube having a wall of sufficient thickness and strength) so that the device does the need the housing for support, but rather is self-supporting.

While the present invention has been explained with reference to the structure disclosed herein, it is not confined to the details set forth and this invention is intended to cover any modifications and changes as may come within the scope and spirit of the following claims.

What is claimed is:

1. A coaxial cable device, said device comprising:

an enclosure defining a cavity, said enclosure having first and second ends, said enclosure having a maximal external transverse dimension;

two coaxial connector bodies, of which one body is disposed at each of said first and second ends of said enclosure, each of said connector bodies configured to connect an external coaxial cable device to an end of a coaxial cable disposed with said enclosure;

a ferrite body disposed within said enclosure; and a coaxial cable disposed within said enclosure adjacent said ferrite body and making at least one circumnavigation thereabout, said coaxial cable connected at a first end to one of said coaxial connector bodies and at a second end to another of said coaxial connector bodies;

whereby sheath currents which are present on the outer surface of a coaxial cable connected to said device are attenuated and corrosion at a ground connection of said coaxial cable is reduced.

2. The device of claim 1 wherein said enclosure comprises non-conducting material.

3. The device of claim 2 wherein said non-conducting material is ABS plastic.

4. The device of claim 2, wherein said maximal external transverse dimension is less than one inch.

5. A coaxial cable device, said device comprising:

a ferrite body;

a coaxial conductor having a first end and a second end, said coaxial conductor disposed adjacent said ferrite body and making at least one circumnavigation thereabout; and a coaxial connector body disposed at each of said first and second ends of said coaxial conductor and electrically connected thereto, each of said connector bodies configured to connect said end of said coaxial conductor to an external coaxial cable-based device;

whereby said coaxial cable device attenuates sheath currents which are impressed on the outer surface of a coaxial cable, thereby attenuating corrosion at a ground connection of said coaxial cable.

6. The coaxial cable device of claim 5, said device further comprising an encapsulant defining a cavity within which said ferrite core and said coaxial conductor are disposed, said encapsulant attached to at least one of said coaxial connector body disposed at either of said first and second ends of said coaxial conductor.

7. The coaxial cable device of claim 5, wherein a maximal external transverse dimension of said device is less than one inch.

8. The coaxial cable device of claim 5, wherein said coaxial conductor comprises a self-supporting outer conductor.

9. The coaxial cable device of claim 8, wherein said self-supporting outer conductor comprises a copper tube having a wall of sufficient thickness and strength.

* * * * *